US008971774B2

(12) United States Patent
Tsunoda

(10) Patent No.: US 8,971,774 B2
(45) Date of Patent: Mar. 3, 2015

(54) FUSER AND IMAGE FORMING DEVICE INCLUDING THE SAME

(75) Inventor: Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 34 days.

(21) Appl. No.: 13/359,601

(22) Filed: Jan. 27, 2012

(65) Prior Publication Data

US 2012/0195655 A1 Aug. 2, 2012

(30) Foreign Application Priority Data

Jan. 28, 2011 (JP) ..... 2011-017247

(51) Int. Cl.
*G03G 15/20* (2006.01)

(52) U.S. Cl.
CPC ..... *G03G 15/2053* (2013.01); *G03G 15/2089* (2013.01); *G03G 15/2064* (2013.01); *G03G 2215/2016* (2013.01); *G03G 2215/2032* (2013.01); *G03G 2215/2029* (2013.01)
USPC ..... 399/329

(58) Field of Classification Search
CPC ..... G03G 15/20
USPC ..... 399/329, 331
See application file for complete search history.

(56) References Cited

U.S. PATENT DOCUMENTS

| | | | | |
|---|---|---|---|---|
| 4,842,944 | A * | 6/1989 | Kuge et al. | 428/451 |
| 8,081,893 | B2 * | 12/2011 | Sato | 399/69 |
| 8,107,868 | B2 * | 1/2012 | Kimura | 399/329 |
| 8,391,764 | B2 * | 3/2013 | Tanaka et al. | 399/329 |
| 8,417,170 | B2 * | 4/2013 | Kimura | 399/329 |
| 2005/0163543 | A1 * | 7/2005 | Satoh et al. | 399/329 |
| 2007/0012676 | A1 * | 1/2007 | Koide et al. | 219/216 |
| 2007/0280757 | A1 * | 12/2007 | Kimura | 399/329 |
| 2007/0292660 | A1 * | 12/2007 | Kikukawa | 428/152 |
| 2008/0219724 | A1 * | 9/2008 | Lee et al. | 399/329 |
| 2009/0047048 | A1 * | 2/2009 | Ikeda et al. | 399/333 |
| 2009/0136273 | A1 * | 5/2009 | Kobayashi | 399/329 |
| 2009/0136274 | A1 * | 5/2009 | Kobayashi | 399/329 |
| 2009/0245900 | A1 * | 10/2009 | Kagawa | 399/329 |
| 2009/0263169 | A1 * | 10/2009 | Kimura | 399/329 |
| 2012/0195655 | A1 * | 8/2012 | Tsunoda | 399/330 |
| 2012/0308281 | A1 * | 12/2012 | Wu et al. | 399/333 |

FOREIGN PATENT DOCUMENTS

| | | | | |
|---|---|---|---|---|
| JP | 2002-072721 A | | 3/2002 | |
| JP | 2005-242111 A | | 9/2005 | |
| JP | 2005242111 | * | 9/2005 | G03G 15/20 |
| JP | 2007-199487 A | | 8/2007 | |
| JP | 2008-040314 A | | 2/2008 | |
| JP | A-2009-017247 | | 1/2009 | |
| JP | 2009-151115 | * | 7/2009 | G03G 15/20 |
| JP | 2009151115 | * | 7/2009 | G03G 15/20 |
| JP | A-2009-151115 | | 7/2009 | |
| JP | 2009-258336 A | | 11/2009 | |
| JP | 2011-191535 A | | 9/2011 | |

* cited by examiner

*Primary Examiner* — Clayton E Laballe
*Assistant Examiner* — Kevin Butler
(74) *Attorney, Agent, or Firm* — Muncy, Geissler, Olds & Lowe, P.C.

(57) ABSTRACT

A fuser includes a first roller that includes a first elastic layer, a belt member provided on, and rotates around, the first roller, a second roller that includes a second elastic layer and that forms a nip part by pressing, through the belt member, the first roller, and a heating member that heats the belt member. A thickness of the second elastic layer of the second roller is less than a thickness of the first elastic layer of the first roller.

41 Claims, 19 Drawing Sheets

| | | Outer Diameter (mm) | Elastic Layer Thickness (mm) | Core Shaft Material | Core Shaft Thickness (mm) | Core Shaft Outer Diameter (mm) | Heat Capacity( J/K) | Starting Pressure Application Roller End-Point Temp. (°C) | Reverse Curling Amount (mm) | Stacking Condition |
|---|---|---|---|---|---|---|---|---|---|---|
| Sample 1 | Fusion Roller | 36 | 5 | A5052 | 1.5 | 26 | 361 | 110 | 8 | ○ |
| | Pressure Application Roller | 36 | 2 | A5052 | 1.5 | 32 | 230 | | | |
| Sample 2 | Fusion Roller | 36 | 5 | A5052 | 1.5 | 26 | 361 | 100 | 10 | ○ |
| | Pressure Application Roller | 36 | 4 | A5052 | 1.5 | 28 | 326 | | | |
| Sample 3 | Fusion Roller | 36 | 5 | A5052 | 1.5 | 26 | 361 | 80 | 20 | △ |
| | Pressure Application Roller | 36 | 6 | A5052 | 1.5 | 24 | 387 | | | |
| Sample 4 | Fusion Roller | 36 | 5 | A5052 | 1.5 | 26 | 361 | 70 | 25 | × |
| | Pressure Application Roller | 36 | 8 | A5052 | 1.5 | 20 | 411 | | | |

○ No Disarrangement
△ With Disarrangement
× Out of Stacker

Fig. 8

| | | Outer Diameter (mm) | Elastic Layer Thickness (mm) | Core Shaft Material | Core Shaft Thickness (mm) | Core Shaft Outer Diameter (mm) | Heat Capacity (J/K) | Starting Pressure Application Roller End-Point Temp. (°C) | Reverse Curling Amount (mm) | Stacking Condition |
|---|---|---|---|---|---|---|---|---|---|---|
| Sample 5 | Fusion Roller | 36 | 5 | A5052 | 1.5 | 26 | 361 | 115 | 5 | ○ |
| | Pressure Application Roller | 36 | 2 | A5052 | 1.0 | 32 | 202 | | | |
| Sample 6 | Fusion Roller | 36 | 5 | A5052 | 1.5 | 26 | 361 | 100 | 10 | ○ |
| | Pressure Application Roller | 36 | 4 | A5052 | 1.5 | 28 | 326 | | | |
| Sample 7 | Fusion Roller | 36 | 5 | A5052 | 1.5 | 26 | 361 | 80 | 20 | △ |
| | Pressure Application Roller | 36 | 6 | A5052 | 1.6 | 24 | 391 | | | |
| Sample 8 | Fusion Roller | 36 | 5 | A5052 | 1.5 | 26 | 361 | 65 | 30 | × |
| | Pressure Application Roller | 36 | 8 | A5052 | 10 | 20 | 541 | | | |

Fig. 12

○ No Disarrangement
△ With Disarrangement
× Out of Stacker

| | | Outer Diameter (mm) | Elastic Layer Thickness (mm) | Core Shaft Material | Core Shaft Thickness (mm) | Core Shaft Outer Diameter (mm) | Heat Capacity (J/K) | Starting Pressure Application Roller End-Point Temp. (°C) | Reverse Curling Amount (mm) | Stacking Condition |
|---|---|---|---|---|---|---|---|---|---|---|
| Sample 8 | Fusion Roller | 25 | 2.0 | STKM | 0.5 | 21 | 121 | 125 | 5 | ○ |
| | Pressure Application Roller | 36 | 0.5 | STKM | 0.5 | 35 | 84 | | | |
| Sample 9 | Fusion Roller | 25 | 2.0 | STKM | 0.5 | 21 | 121 | 110 | 8 | ○ |
| | Pressure Application Roller | 36 | 1.0 | STKM | 0.5 | 34 | 120 | | | |
| Sample 10 | Fusion Roller | 25 | 2.0 | STKM | 0.5 | 21 | 121 | 90 | 20 | △ |
| | Pressure Application Roller | 36 | 2.0 | STKM | 0.5 | 32 | 184 | | | |
| Sample 11 | Fusion Roller | 25 | 2.0 | STKM | 0.5 | 21 | 121 | 80 | 25 | × |
| | Pressure Application Roller | 36 | 3.0 | STKM | 0.5 | 30 | 240 | | | |

Fig. 16

○ No Disarrangement
△ With Disarrangement
× Out of Stacker

FUSER AND IMAGE FORMING DEVICE INCLUDING THE SAME

CROSS REFERENCE TO RELATED APPLICATION

The present application is related to, claims priority from and incorporates by reference Japanese Patent Application No. 2011-017247, filed on Jan. 28, 2011.

TECHNICAL FIELD

The present application relates to a fuser used in an electrographic type image forming device and the image forming device that includes the fuser.

BACKGROUND

A conventional image forming device using an electrographic method forms an electrostatic latent image that corresponds to image information by exposing a surface of a photosensitive drum using an exposure head, such as a light emitting diode (LED) and the like after uniformly charging the surface of the photosensitive drum by a charging roller. Then, a toner image is formed by electrostatically attaching a thin layer of toner on a development roller to the electrostatic image. After transferring the toner image onto a sheet carried by a carrying belt using a transfer roller, an image is formed on the sheet by fixing the toner image using a fuser.

This type of image forming device uses a belt heating type fuser. In such a fuser, a fusion belt formed by an endless belt is heated, and a fusion roller is pressed by a pressure application roller facing across the fusion belt, thereby forming a nip part. The carried sheet is pinched by the nip part, and the toner image is fixed onto the sheet by heat and pressure. See Japanese Laid-Open Patent Application No. 2009-151115 (paragraphs 0012-0020, 0028 and FIG. 1).

However, in the above-described conventional technology, because the toner image is fixed onto the sheet by pinching the sheet that has been carried, by the nip part formed by pressing the fusion roller with the pressure application roller facing across the fusion belt, there is a problem that excess reverse curling occurs on the sheet after the fusion if a temperature difference between the pressure application roller and the fusion belt and fusion roller is large at the time of fusion.

Such a sheet with a large amount of reverse curling causes carrying ability of the sheet after fusion and stackability of the sheet on a stacker to be reduced. The present application is made in consideration of solving the above-described problem and has an object to provide a device that suppresses the reverse curling amount at the time of fusion at the fuser.

SUMMARY

In order to solve the above subjects, a fuser of the present invention includes a first roller that includes a first elastic layer, a belt member provided on, and rotates around, the first roller, a second roller that includes a second elastic layer and that forms a nip part by pressing, through the belt member, the first roller, and a heating member that heats the belt member. A thickness of the second elastic layer of the second roller is less than a thickness of the first elastic layer of the first roller. In another view, an image forming device of the present invention includes the fuser discussed above.

As a result, the present application as an advantage to increase a surface temperature of the pressure application roller to a temperature needed to start printing by increasing a speed to raise the temperature of the second roller (for example, a pressure application roller) and to suppress the reverse curling amount generated on a sheet by reducing the temperature difference between the first roller (for example, a fusion roller) and the pressure application roller at the time of fusion.

BRIEF DESCRIPTION OF THE DRAWINGS

FIG. 8 is an explanatory diagram illustrating evaluation results of the pressure application roller of the first embodiment.

FIG. 9 is a graph illustrating a relationship, in the first embodiment, between an elastic layer thickness of the pressure application roller and a temperature to which the pressure application roller reaches at the time of turning on.

FIG. 12 is an explanatory diagram illustrating evaluation results of the pressure application rollers in the first embodiment with equalized flexure strength.

FIG. 16 is an explanatory diagram illustrating evaluation results of the pressure application roller of the second embodiment.

FIG. 17 is a graph illustrating a relationship, in the second embodiment, between an elastic layer thickness of the pressure application roller and a temperature to which the pressure application roller reaches at the time of turning on.

DETAILED DESCRIPTION OF EMBODIMENTS

Embodiments of a fuser and an image forming device according to the present specification are explained below with reference to the drawings.

First Embodiment

Figure 1:
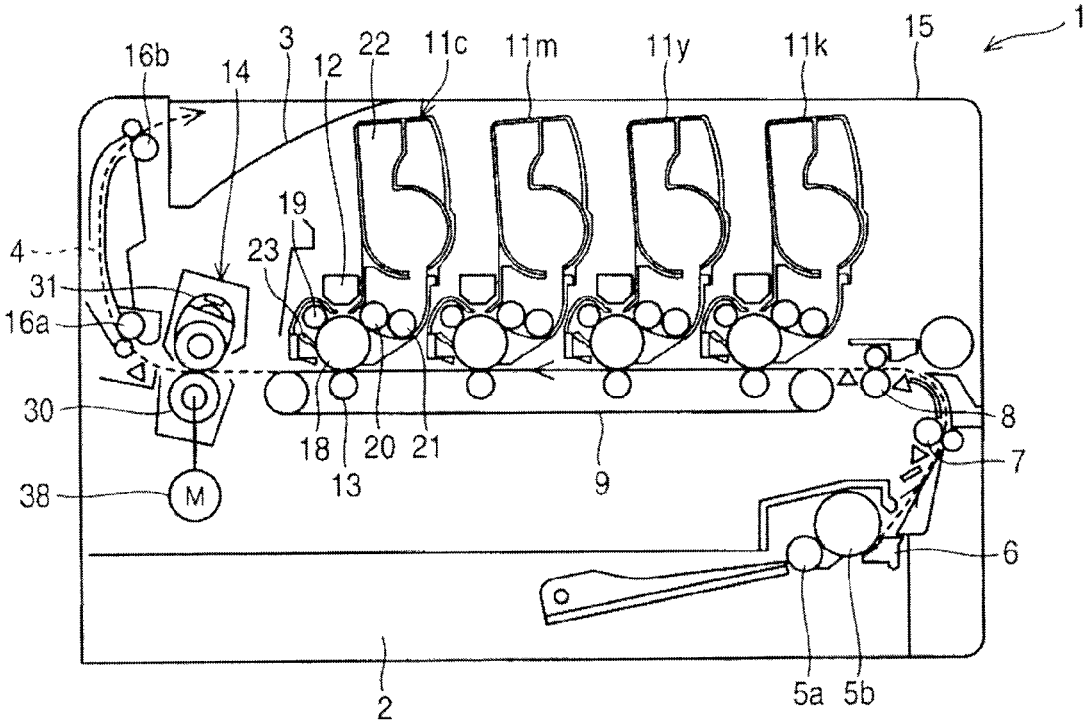
FIG. 1 is an explanatory diagram illustrating a side surface of a schematic configuration of a printer of a first embodiment.

In FIG. 1, reference numeral 1 is a printer as an image forming device. The printer 1 of the present embodiment is an electrographic color printer that prints color images. In the printer 1, a sheet cassette 2 that accommodates sheets P as printing media, such as normal paper and the like, is removably installed in a lower part of a device housing of the printer 1, and a stacker 3 on which the sheets P with images printed thereon are stacked is provided on an upper surface of the exterior part of the printer 1. The sheet cassette 2 and the stacker 3 are connected by a sheet carrying path 4 formed in an approximately S shape as shown by a broken line in FIG. 1 (including a top surface part of a parallel part of the later-discussed carrying belt 9).

A sheet supply mechanism that is formed by sheet supply rollers 5*a* and 5*b* and a separation piece 6 and that separates and feeds each of the sheets P from the sheet cassette 2 is provided at a connection part between the sheet carrying path 4 and the sheet cassette 2. Carrying rollers 7 that pinch and carry each sheet P that is fed from the sheet supply mechanism and registration rollers 8 that correct diagonal traveling of and carry the sheet P carried by the carrying rollers 7 are provided on the downstream side of the sheet supply roller 5*b* in the carrying direction of the sheet P ("sheet carrying direction").

A carrying belt 9 that carries the sheet P carried by the registration rollers 8 is positioned on the downstream side of the registration rollers 8 in the sheet carrying path. Above a top surface part of the paralleled part of the carrying belt 9, a plurality of image forming parts 11 are provided along the carrying belt 9. An exposure head 12 for forming an electrostatic latent image is provided above each image forming part 11. On the opposite side of the top surface part of the carrying belt 9, a transfer roller 13 is provided that transfers a toner image as a developer image formed by the image forming part 11 onto the sheet P. A fuser 14 that fixes the toner image transferred on the sheet P is provided on the downstream side of the transfer belt 9 in the sheet carrying direction. Moreover, a plurality of ejection rollers 16*a* and 16*b* that pinch and carry the sheet P ejected from the fuser 14 to the stacker 3 on a top cover 15 are arranged on the downstream side of the fuser 14 in the sheet carrying direction.

In the printer 1 of the present embodiment, there are four independent image forming parts 11*k*, 11*y*, 11*m* and 11*c* that accommodate toners T in black (K), yellow (Y), magenta (M) and cyan (C), respectively, as developers and that are provided in the order along the sheet carrying direction to form toner images. Because these four image forming parts 11 have the same configuration, only one image forming part 11 is explained below.

The image forming part 11 includes a photosensitive body, such as photosensitive drum 18, on which an electrostatic latent image is formed by the exposure head 12, a charging roller 19 that uniformly charges the photosensitive drum 18, a development roller 20 that develops an image by attaching the toner T to the electrostatic latent image on the photosensitive drum 18, a supply roller 21 that supplies the toner T to the development roller 20, a toner cartridge 22 that accommodates the toner T of a set color, a cleaning blade 23 that removes the toner T remained on the photosensitive drum 18 after transfer by scraping off the toner T from the photosensitive drum 18, and the like. In addition, each image forming part 11 is integrally configured and is removably installed in the printer 1. Therefore, the top cover 15 of the printer 1 is configured to be able to open and close.

The exposure head 12 as an exposure device is supported by the top cover 15 and is provided above, and to face, the photosensitive drum 18. The exposure head 12 includes a light emitting body such as light emitting diode (LED) light that emits light, laser light and the like, and forms an electrostatic latent image on the surface of the photosensitive drum 18 based on image information. The transfer roller 13 as a transfer device is provided to face the photosensitive drum 18 across the carrying belt 9 and transfers, by a transfer voltage applied thereto, the toner image formed on the photosensitive drum 18 onto the sheet P carried by the carrying belt 9.

Figure 2:
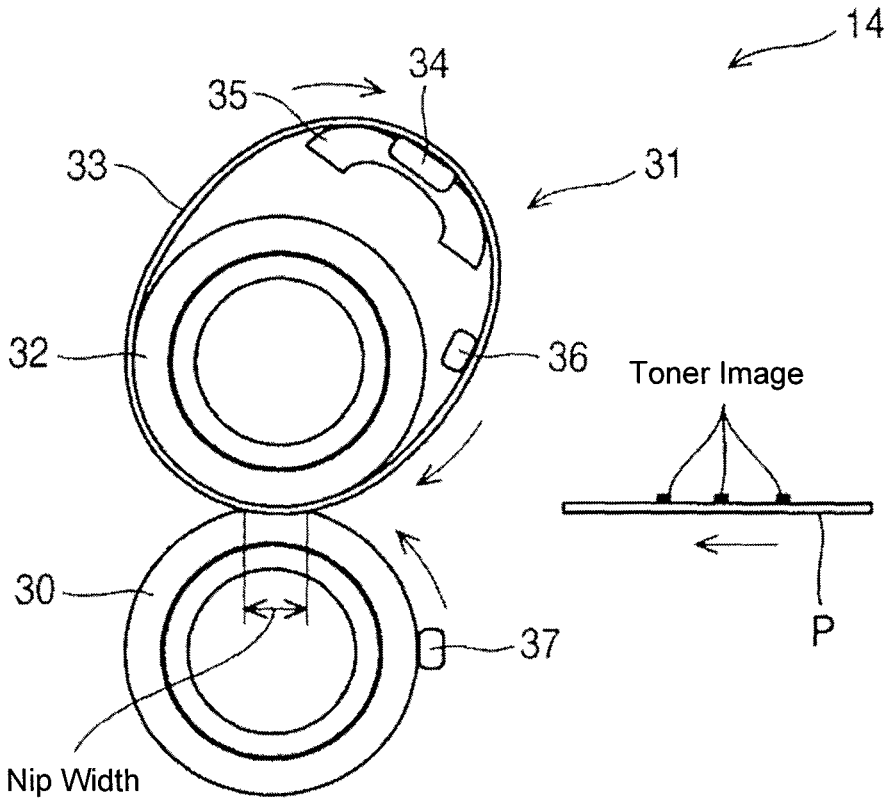
FIG. 2 is an explanatory diagram illustrating a cross-section of a main part of a fuser of the first embodiment.

The fuser 14 of the present embodiment is a belt heating type device and is configured from a pressure application roller 30 (as the second roller) and a fusion belt unit 31 as shown in FIG. 2. The fusion belt unit 31 is configured from a fusion roller 32 (as the first roller), a fusion belt 33, a heater 34, a heater holder 35 that also functions as a guide for the fusion belt 33, and the like.

The pressure application roller 30 and the fusion roller 32 of the fusion belt unit 31 are arranged to face, and parallel with, each other across the fusion belt 33. The pressure application roller 30 presses the fusion belt unit 31 at a predetermined pressure by a pressure mechanism (not shown) provided to the pressure application roller. As a result, a nip part is formed between the fusion belt 33 and the pressure application roller 30 with a predetermined nip width in the sheet carrying direction.

A belt temperature sensor 36 as a belt temperature detection device configured from a thermistor or the like that slides on, and detects a temperature of, an inner circumferential surface of the fusion belt 33 is provided between the heater 34 of the fusion device 14 and the nip part and on the upstream side of, and near, the nip part in the rotational direction (clockwise direction in FIG. 2) of the fusion belt 33. In addition, a pressure application roller temperature sensor 37 as a pressure application roller temperature detection device configured from a thermistor or the like that slides on, and detects a temperature of, an outer circumferential surface of the pressure application roller 30 is provided on the upstream side of, and near, the nip part of the pressure application roller 30 in the rotational direction of the pressure application roller 30. The fuser 14 may be integrally or removably installed to the printer 1.

Figure 3:
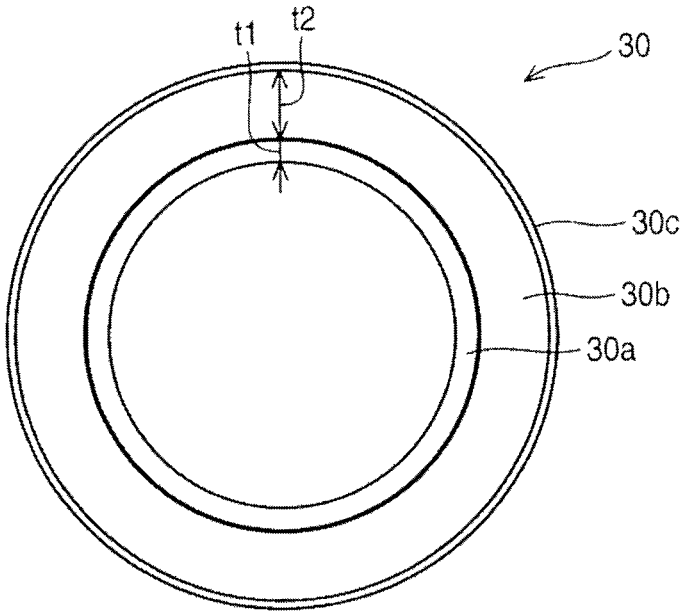
FIG. 3 is an explanatory diagram illustrating a configuration of a pressure application roller of the first embodiment.

As shown in FIG. 3, the pressure application roller 30 is configured from a core shaft 30*a*, a heat resistant elastic layer 30*b* as a second elastic layer, and a release layer 30*c* formed of fluorine resin or the like and is rotatably supported by a bearing (not shown). The pressure application roller 30 is driven by a drive force transmitted from a fusion motor 38 (see FIG. 1) to a pressure application roller gear (not shown) provided at the core shaft 30*a* in order to rotate in a rotational direction to carry the sheet P in the sheet carrying direction shown by an arrow in FIG. 2 (the counterclockwise direction in FIG. 2 is referred to as a carrying rotational direction).

The core shaft 30*a* of the pressure application roller 30 of the present embodiment is configured from a pipe made of an aluminum material (A5052) with a thickness t1 (maybe referred to as "core shaft thickness t1") and a length of 230 mm. A silicone rubber layer having a thickness t2 (maybe referred to as "elastic layer thickness t2") is formed as an elastic layer 30*b* on the outer circumferential surface of the pipe. The surface of the pressure application roller 30 is covered by a perfluoroalkyl vinyl ether copolymer (PFA) resin tube, which is a type of fluorine resin, as the release layer 30*c* having a thickens of 40 μm. The pressure application roller 30 has an outer diameter of 36 mm. The thickness t1 of the core shaft 30*a* and the thickness t2 of the elastic layer 30*b* are discussed later.

Figure 4:
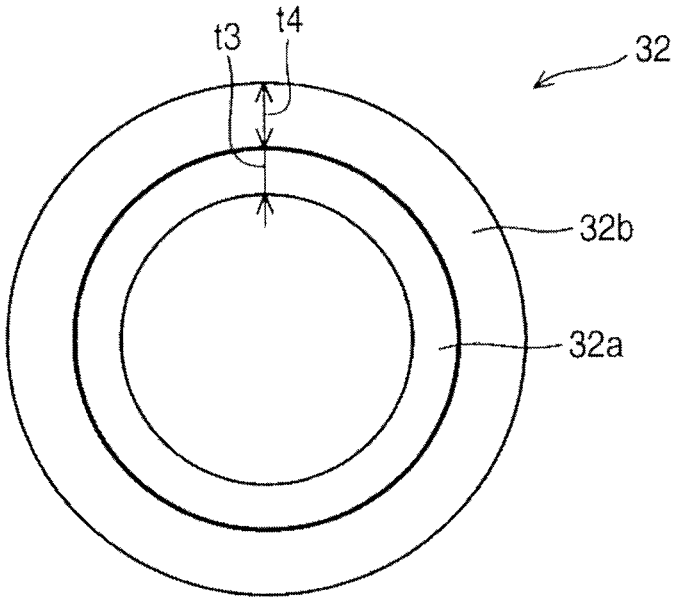
FIG. 4 is an explanatory diagram illustrating a configuration of a fusion roller of the first embodiment.

As shown in FIG. 4, the fusion roller 32 is configured form a core shaft 32*a* formed by a pipe or shaft made of a metal such as iron, aluminum alloy and the like, and a heat resistant elastic layer 32*b*, such as a silicone rubber, fluorine resin or the like, as a first elastic layer. The fusion roller 32 is rotatably supported by a bearing (not shown) and rotates together with the pressure application roller 30 in accordance with the rotation of the fusion belt 33 that is rotated together by a frictional force at the nip part due to the rotation of the pressure application roller 30. The core shaft 32*a* of the fusion roller 32 of the present embodiment is configured from a pipe made of an aluminum material (A5052) with a diameter of 26 mm, a thickness t3 of 1.5 mm (t3=1.5 mm; maybe referred to as "core shaft thickness t3") and a length of 230 mm, and a silicone rubber layer having a thickness t4 of 5 mm (t4=5 mm; maybe referred to as "elastic layer thickness t4") formed as an elastic layer 32*b*. The fusion roller 32 has an outer diameter of 36 mm.

Figure 5:
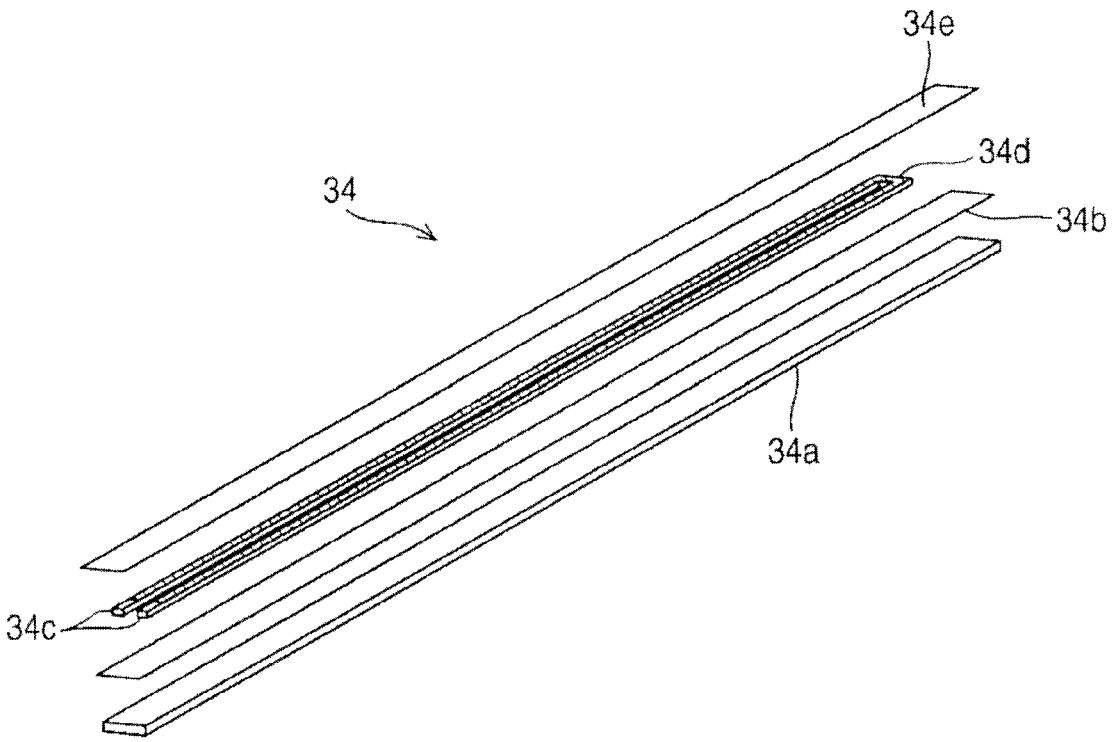
FIG. 5 is an explanatory diagram illustrating a heater of the first embodiment.

As shown in FIG. 5, the heater 34 as a heating body is a sheet heater in a slender shape configured from electric insulation layer 34*b*, such as a glass or the like, provided on a substrate 34*a*, such as stainless steel, ceramic or the like, a resistance heating body 34*d* having an electrode 34*c* formed on the electric insulation layer, and a protective layer 34*e* protecting the resistance heating body 34*d*. A material, such as nickel-chrome alloy, silver-palladium alloy and the like may be used for the resistance heating body 34*d*. Moreover, a glass coating using a pressure resistant glass is applied on the protective layer 34*e*. The sheet heater is disposed such that the longitudinal direction is substantially identical to an axis of the belt 33 that is a heating target.

The heater holder 35 is positioned distant from the fusion roller 32 on the opposite side of the pressure application roller 30 and to face the fuser roller 32. The heater holder 35 supports the fusion belt 33 with the fusion roller 32 so that the fusion belt 33 is rotatably tensioned. The heater holder 35 is configured by a resin with high heat resistance, such as polyether ether ketone (PEEK), liquid crystal polymer (LCP) or the like. The heater 34 is fixedly supported along a longitudinal direction of, and on a top center part of, the heater holder 35 with a heat resistant adhesive or the like.

Figure 6:
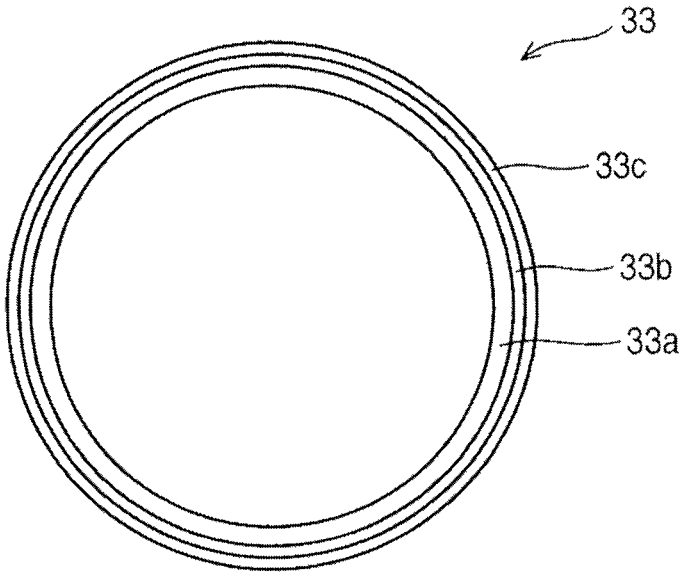
FIG. 6 is an explanatory diagram illustrating a configuration of a fusion belt of the first embodiment.

As shown in FIG. 6, the fusion belt 33 is formed by a heat resistant elastic layer 33*b*, such as a silicone rubber, fluorine resin or the like, provided on an outer circumferential surface of a tubular belt base 33*a* made of a material, such as nickel, polyimide, stainless steel or the like, and a release layer 33*c* made of a fluorine resin or the like on an outer circumferential surface of the elastic layer 33*b*. The fusion belt 33 rotates together with the pressure application roller 30 by the frictional force at the nip part due to the rotation of the pressure application roller 30 and is heated by the heater 34. The fusion belt 33 of the present embodiment is an endless belt with a polyimide steel tubular member having a thickness of 50 μm as the belt base 33*a*, a silicone rubber layer having a thickness of 100 μm provided as the elastic layer 33*b* and a PFA resin layer having a thickness of 30 μm formed as the release layer 33*c*.

Moreover, regarding the inner diameter of the fusion belt 33, the time to raise the temperature of the fusion belt 33 increases if a circumferential length of the fusion belt 33 is long, and a space would be insufficient if the circumferential length is short, causing the outer diameter of the fusion roller 32 needed for securing a nip width to be reduced. Therefore, the outer diameter of the fusion 32 is configured to 36 mm, and the inner diameter of the fusion belt 33 is configured to 45 mm. In addition, an output of the heater 34 is configured to 900 W. The pressure application roller 30 is configured to press the fusion belt 33 at 10 kgf on each side, or the total of 20 kgf, by a pressure mechanism (not shown). Moreover, for the printer 1 of the present embodiment, the print speed is configured to 30 ppm (page/minute) for A4 (portrait), and the warm-up time is configured to 30 seconds.

Figure 7:
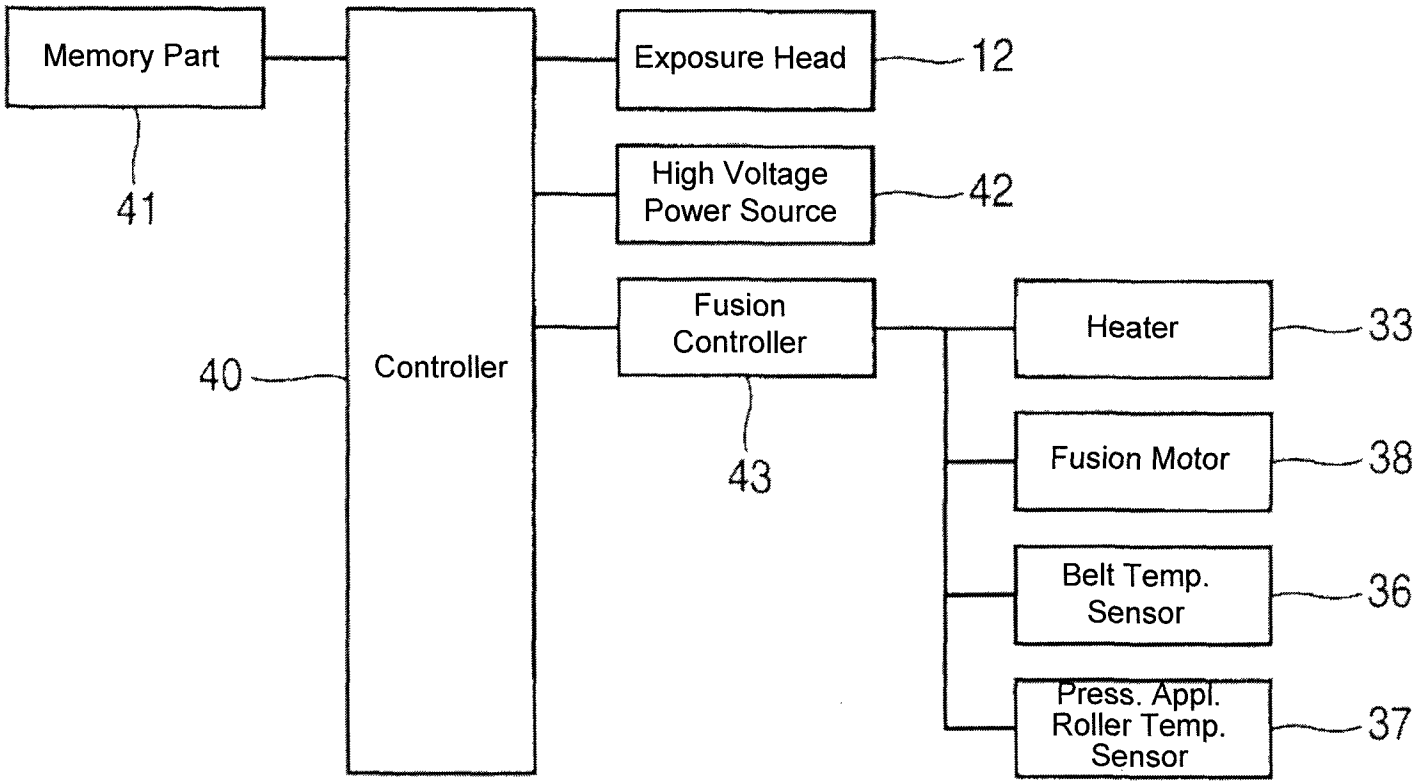
FIG. 7 is a block diagram illustrating a control system of the printer of the first embodiment.

In FIG. 7, reference numeral 40 is a controller for the printer 1 that is connected to a host device, such as a personal computer, via a communication network (not shown). The controller 40 has a function to execute print process and the like by controlling each part in the printer 1 and a function to control the data communication with the host device. Reference numeral 41 is a memory part of the printer 1 that stores programs to be executed by the controller 40, various data used for the programs, processing results by the controller 40 and the like.

Reference numeral 42 is a high voltage power source that applies voltage to the charging roller 19, the development roller 20, the supply roller 21, the transfer roller 13 and the like based on a command from the controller 40. The charging roller 19, the development roller 20, the supply roller 21 and the like are electrically connected to the high voltage power source 42 when the image forming part is installed in the printer 1.

Reference numeral 43 is a fusion controller that supplies power for heating to the heater 34 of the fuser 14 from a power supply circuit (not shown) and rotates the pressure application roller 30 in the carrying rational direction by supplying power to the fusion motor 38 based on a command from the controller 40.

In addition, a surface temperature of the fusion belt 33 detected by the belt temperature sensor 36, a surface temperature of the pressure application roller 30 detected by the pressure application roller temperature sensor 37, and the like are inputted to the fusion controller 43. The controller 40 turns on and off the power supplied to the heater 34 by the fusion controller 43 based on the surface temperature of the fusion belt 33 inputted to the fusion controller 43 and controls the surface temperature of the fusion belt 33 to be maintained in a predetermined fusion temperature.

Operation of each part during the printing operation of the printer 1 of the present embodiment is explained below. The controller 40 of the printer 1 starts printing in accordance with a print order when the print order is received from a host device. The controller 40 then feeds the sheet P accommodated in the sheet cassette 2 to the sheet carrying path 4 by separating each sheet using the sheet supply rollers 5*a* and 5*b* and a separation piece 6 and carries sheet P to the carrying belt 9 using the carrying rollers 7 and the registration rollers 8.

In parallel with this, the controller 40 applies predetermined voltage that is configured in advance to each of rollers in each image forming part 11 and the transfer roller 13 using the high voltage power source 42 and uniformly charges the surface of each photosensitive drum 18 by charging voltage applied to the charge roller 19 of each image forming part 11. The controller 40 then causes each exposure head 12 to emit light in accordance with image information based on the print order and forms an electrostatic latent image on the surface of each photosensitive drum 18 by exposure. The controller 40 develops the electrostatic latent image on the photosensitive drum 18 by attaching to toner T supplied from the supply roller 21 onto the surface of the photosensitive drum 18 using the development roller 20 to form a toner image of the corresponding color on the surface of the photosensitive drum 18.

As the sheet P is carried to the image forming part 11 by the carrying belt 9, toner images in black, yellow, magenta and cyan are sequentially transferred onto the sheet P by transfer voltage applied to the transfer roller 13 while the sheet P passes between the transfer roller 13 and the photosensitive drums 18 in the respective image forming parts 11*k*, 11*y*, 11*m* and 11*c*, and thereby a color toner image is formed.

As the sheet P with the toner image transferred thereon is carried to the fuser 14, the toner image is fixed to the sheet P by the fuser 14 and is ejected and stacked to the stacker 3 on the top cover 15 by the ejection rollers 16*b* after being carried by the ejection rollers 16*a* to complete the print operation.

Fusion operation by the fuser 14 in this case is explained below. First, the controller rotates the fusion motor 38 using the fusion controller 43 in accordance of the start of printing in the printer 1. The controller 40 then rotates a pressure application roller gear of the pressure application roller 30 for the fuser 14 via a drive gear array (not shown) provided in the main body of the printer 1 and causes the fusion belt 33 and the fusion roller 32 to follow and to be rotated by the frictional force at the nip part in accordance with the rotation of the pressure application roller 30.

In addition, the controller 40 supplies power to the heat 34 from the power supply circuit 34 using the fusion controller 43 to generate heat and to heat the fusion belt 33 from the inner circumferential surface side. The temperature of the fusion belt 33 heated by the heater 34 is detected by the belt temperature sensor 36 and is inputted to the fusion controller 43. The fusion controller 43 turns on and off the power that is supplied to the heater 34 from the power supply circuit based on the detected surface temperature of the fusion belt 33 to control the surface temperature of the fusion belt 33 to be maintained at the predetermined fusion temperature.

As the sheet P with the toner image transferred thereon is carried in a state where the surface temperature of the fusion belt 33 is maintained at the predetermined fusion temperature, the sheet P is pinched by the nip part formed by the fusion roller 32 and the pressure application roller 30 via the fusion belt 33. Then the sheet P is heated by the fusion belt 33 at a predetermined fusion temperature and pressed by the pressure application roller 30 at a predetermined pressure. As a result, the toner image is fixed to the sheet P.

In addition, it is preferable that the pressure application roller 30 starts rotating without delay from the time when the heater 34 is turned on because the pressure application roller 30 of the present embodiment does not include a heat generating body. Therefore, in the present embodiment, the pressure application 30 is configured to start rotating at the time when the heater 34 is turned on. Moreover, a target temperature of the fusion belt 33 of the present embodiment is configured to 160° C., and the temperature of the fusion belt 33 is controlled to reach the fusion temperature configured from a predetermined temperature range having the target temperature as a median value at the time of executing fusion after the heater 34 is turned on.

For the belt heating type fuser 14 with the configuration of the present embodiment, the evaluation test indicated below was conducted by changing the thickness t2 (see FIG. 3) of the elastic layer 30*b* of the pressure application roller 30 to study a configuration for suppressing the reverse curling amount.

As shown in FIG. 8, sample pressure application rollers 30 subject for the evaluation had an outer diameter of 36 mm with a core shaft 30*a* (material: A5052) having the same thickness t1 of 1.5 mm and an elastic layer 30*b* of various thicknesses t2 of 2 mm, 4 mm, 6 mm and 8 mm (first to fourth samples (samples 1 to 4)). In addition, the same fusion roller 32 was paired with respective sample pressure application rollers 30. The fusion roller 32 had an outer diameter of 36 mm and included a core shaft 32*a* (material: A5052) having a thickness of 1.5 mm and an elastic layer 32*b* having a thickness 5 mm. Also, the same fusion belt 33 having the above-described configuration was used.

In the print operation, the print can be started when the temperature of the fusion belt 33 reaches the fusion target temperature from the room temperature. The surface temperature of the pressure application roller 30 that is detected by the pressure roller temperature sensor 37 at this time is called a starting pressure application roller end-point temperature.

For the evaluation test, the fuser 14 with the sample pressure application roller 30 attached therein was installed in the printer 1, and 50 A4-size sheets P (Oki Data Excellent Paper) were fed in the portrait orientation and were continuously printed at 30 pages-per-minute (ppm) with a printer pattern that achieves 5% toner duty after turning on the power and completing warm-up. A reverse curling amount after ejection of the first sheet P and a stacking condition of the 50 sheets P after ejection were configured as evaluation items. In addition, the evaluation was conducted under a high-temperature-high-humidity environment (HH environment), under which the sheet P after fusion becomes easily reverse-curled.

The reverse curling in the present explanation is a state of the sheet P where the sheet P convexly curls with the surface of the sheet P on which the toner T has been fixed facing upward. Evaluation results of each sample pressure application roller 30 according to the above-described evaluation conditions are shown in FIG. 8.

As shown in FIG. 8, it is observed that the starting pressure application roller end-point temperature at the time of start of printing immediately after the warm-up of the pressure application roller 30 is at a temperature at which the reverse curling amount that causes a stacking failure does not occur, when the elastic layer thickness t2 of the pressure application roller 30 is less than the elastic layer thickness t4 of the fusion roller 32.

Figure 9:
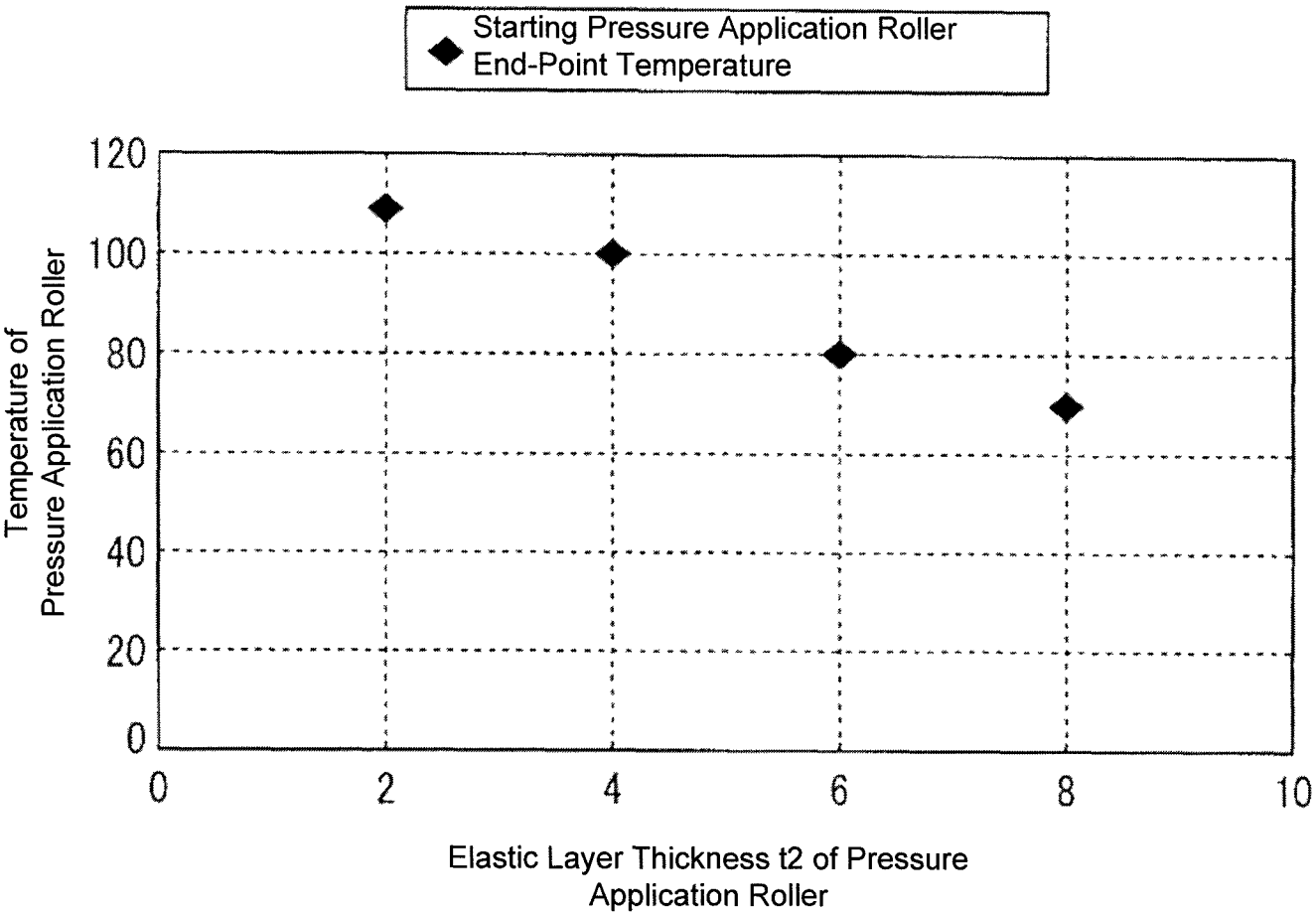
Figure 10:
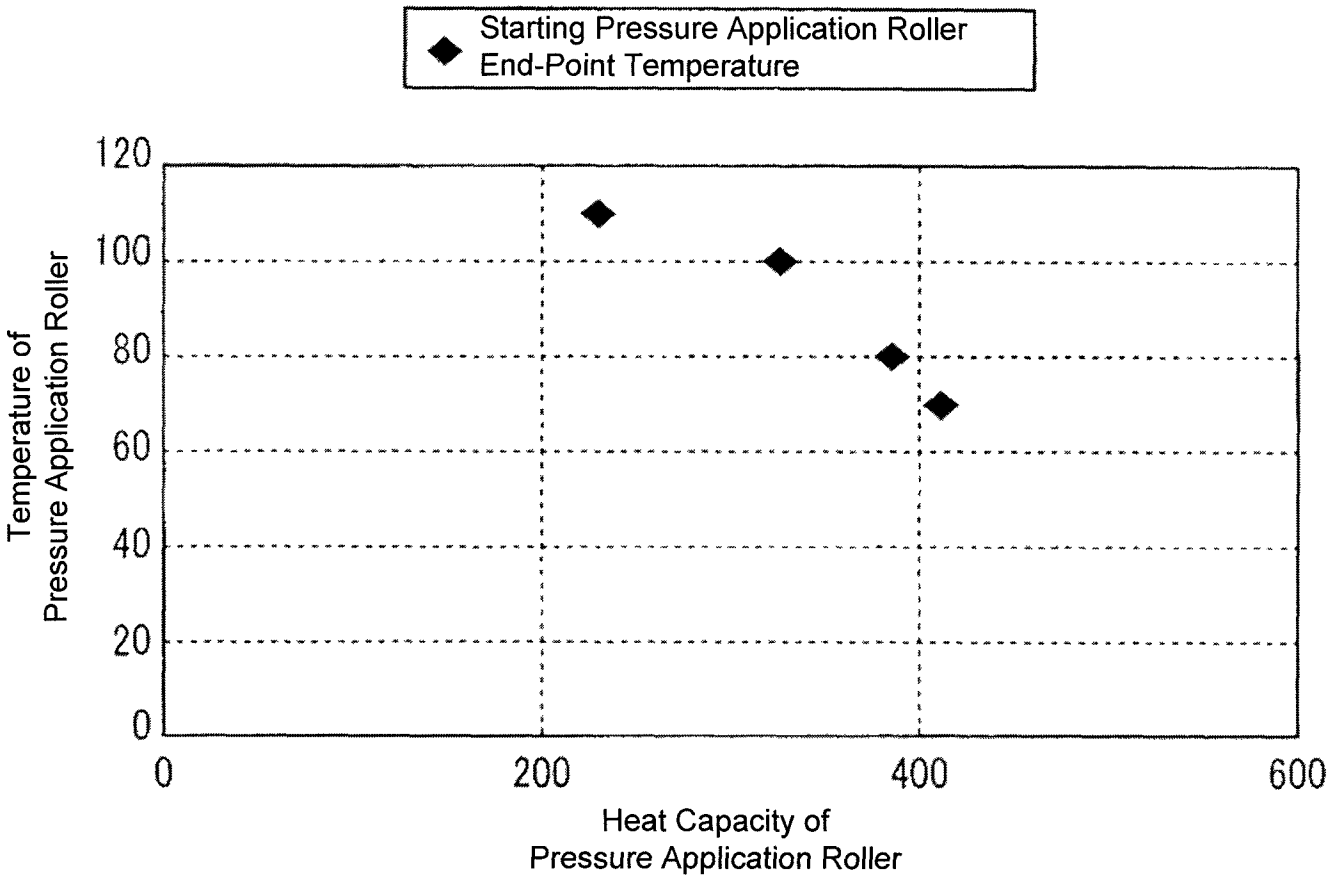
FIG. 10 is a graph illustrating a relationship between a heat capacity of the heat application roller and the temperature to which the pressure application roller reaches at the time of turning on in the first embodiment.

Explaining in more details, as shown in FIG. 9, the starting pressure application roller end-point temperature at the time when the fusion belt 33 reaches the fusion target temperature fusion from the from the room temperature at the time of warming up increases from 70° C. to 110° C. as the elastic layer thickness t2 of the pressure application roller 30 decreases from 8 mm to 2 mm. Moreover, as shown in FIG. 10, the starting pressure application roller end-point temperature increases from 70° C. to 110° C. as a heat capacity of the pressure application roller 30 is decreased from 411 J/K to 230 J/K.

Figure 11:
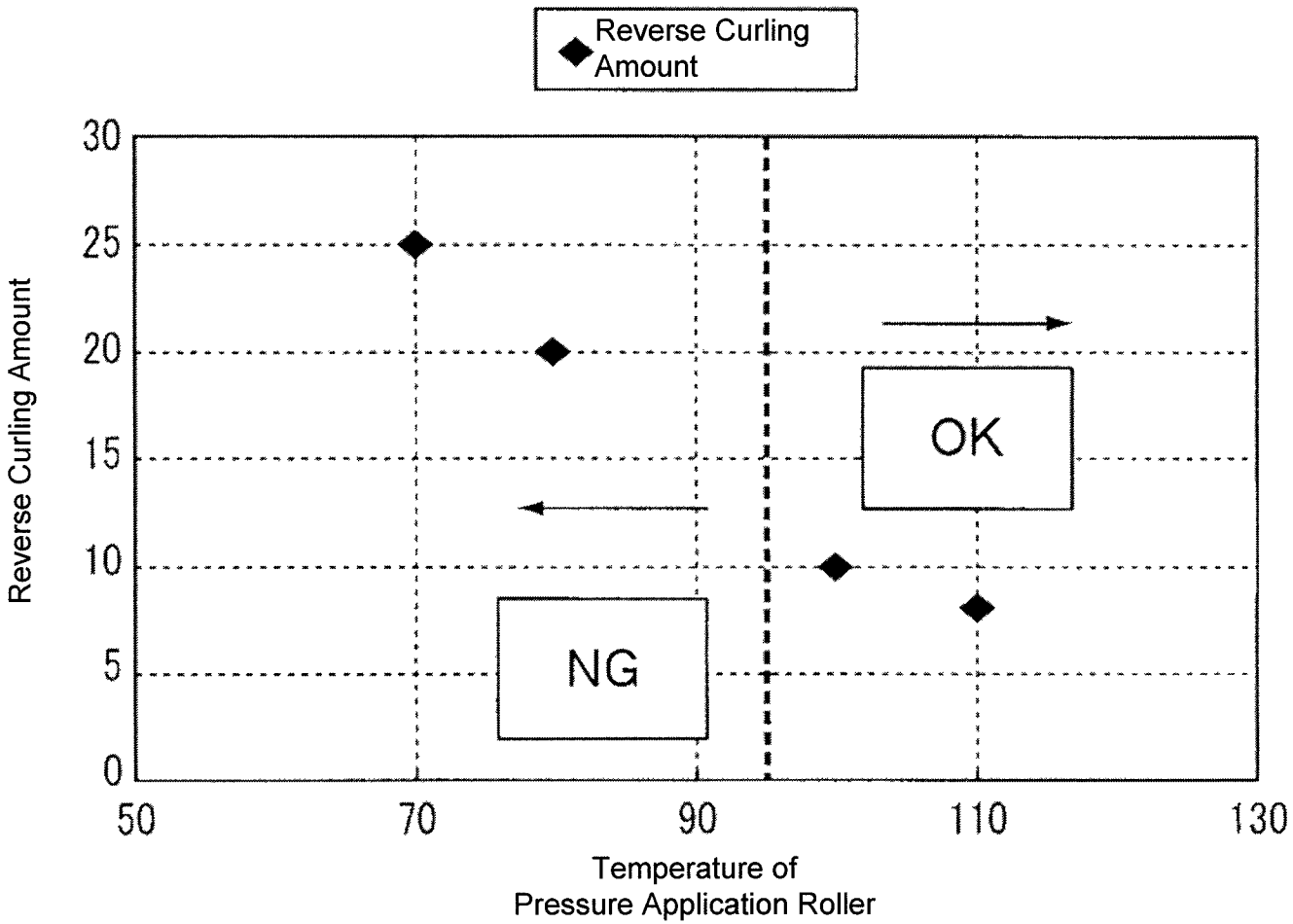
FIG. 11 is a graph illustrating a relationship between the temperature to which the pressure application roller reaches at the time of turning on and an amount of reverse curling in the first embodiment.

As shown in FIG. 11, the reverse curling amount of the sheet P at this time decreases from 25 mm to 8 mm as the starting pressure application roller end-point temperature increases. The stacking condition after printing 50 sheets shows no or little disarrangement when the reverse curling amount is 10 mm or less.

That is, if the relationship of thicknesses between the elastic layer 30*b* of the pressure application roller 30 and the elastic layer 32*b* of the fusion roller 32 is configured to a. Elastic layer thickness t2 of pressure application roller<Elastic layer thickness t4 of fusion roller (1)

the reverse curling amount at the time of start of printing immediately after the warm-up is controlled at 10 mm or less, resulting in an excellent stacking condition.

In addition, if the relationship of heat capacity of the pressure application roller 30 and heat capacity of the fusion roller 32 is configured to a. Heat capacity of pressure application roller<Heat capacity of fusion roller (2)

the reverse curling amount at the time of start of printing immediately after the warm-up is controlled at 10 mm or less, resulting in an excellent stacking condition.

As described above, it was understood that a large reverse curling amount occurs when the heat capacity is large and that the reverse curling amount is small when the heat capacity of the heat roller 30 is reduced, even with the same configuration. When the relationship of the elastic layer thickness t4 of the fusion roller 32 and fusibility was studied by another test, occurrence of fusion defects was slightly observed with the elastic layer thickness t4 of 1 mm. Therefore, it is necessary that a more preferred elastic layer thickness t4 of the fusion roller 32 is 2 mm or more.

In addition to the above-described evaluation test, for the fifth to seventh samples (samples 5 to 7) with the same outer diameter and the core shaft thickness t1 of the pressure application roller 30 that has been configured so that a flexure strength to be equalized in response to the elastic layer thickness t2, with the pressure application roller 20 of the second sample as a reference, a similar evaluation test was conducted based on the combination with the above-described fusion roller 32 and the fusion belt 33. The evaluation results are shown in FIG. 12. The core shaft 30*a* of the pressure application roller 30 of the seventh sample is a solid shaft having an outer diameter of 20 mm.

As shown in FIG. 12, when the heat capacity of the pressure application roller 30 is less than the heat capacity of the fusion roller 32, the starting pressure application roller endpoint temperature at the time of start of printing immediately after warming up the pressure application roller 30 is at a temperature at which the reverse curling amount that causes the stacking defect does not occur. It was observed that the occurrence of the reverse curling amount is further suppressed when the heat capacity of the core shaft 30*a* is smaller compared with the evaluation results of the samples shown in FIG. 8 (see sample 5).

As described above, in the present embodiment, the thickness of the elastic layer 30*b* of the pressure application roller 30 for the fuser 14 is made less than the thickness of the elastic layer 32*b* of the fusion roller 32. Therefore, the temperature of the pressure application roller 30 increases fast, and the surface temperature of the pressure application roller 30 is increased, during the warm-up, to the temperature needed for start of printing. As a result, the difference in temperatures of the fusion unit 31 and the pressure application roller 30 at the time of fusion is reduced, and the difference in dryness of the front and back sides of the sheet P are decreased. Accordingly, the fuser 14 that allows the reverse curling amount to be reduced can be provided. In addition, because the temperature increase of the fusion roller 30 is increased, the warm-up time at the time of start of printing is shortened.

Furthermore, the printer 1 of the present embodiment, with the fuser 14, provides excellent sheet carrying ability and stackability for the fusion process after being turned on and recovery from a power saving mode. In addition, the preset embodiment is explained with a sheet heater as the heating member. However, the heater may be a halogen heater 45.

Figure 13:
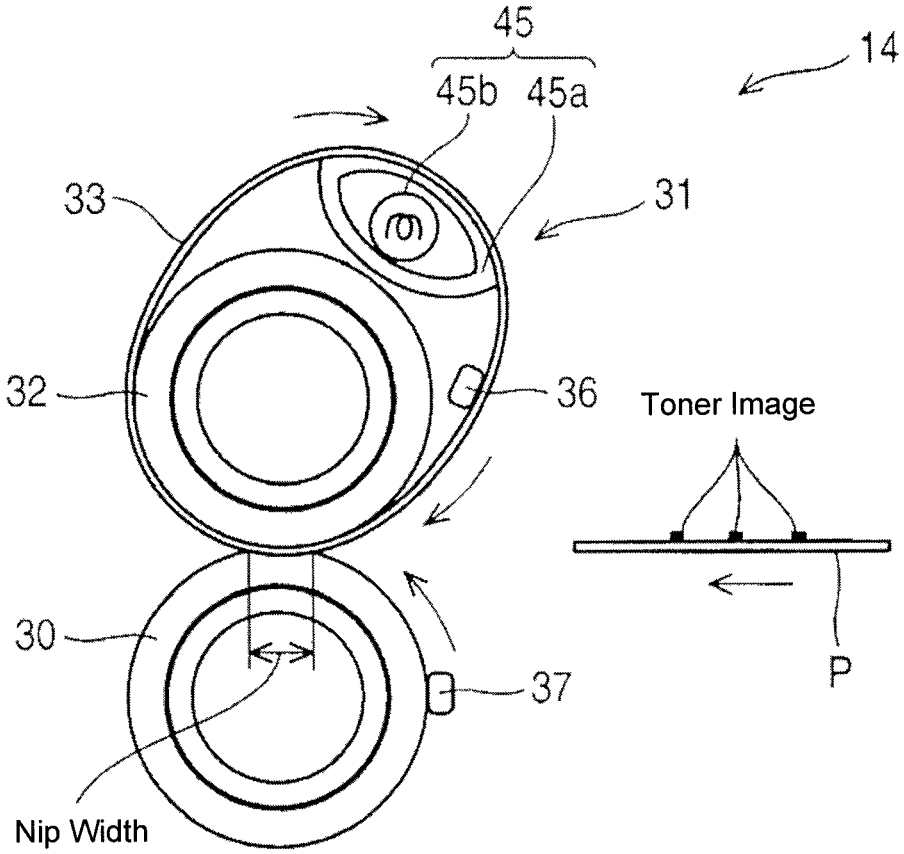
FIG. 13 is an explanatory diagram illustrating another form of the heater of the first embodiment.

The halogen heater 45 is configured from a halogen lamp 45*b* as a heat generating body built in a heater cover 45*a* as shown in FIG. 13. Heat is transmitted from the halogen lamp 45*b* to the fusion belt 33 through a sliding surface between heater cover 45*a* and the fusion belt 33, and thereby the fusion belt 33 is heated from the inner circumferential surface side. In addition, the heater cover 45*a* of the halogen heater 45 is positioned distant from the fusion roller 32 on the opposite side of the pressure application roller 30 and to face the fuser roller 32. Similar to the heater holder 35, the heater cover 45*a* has a function to support the fusion belt 33 with the fusion roller 32 so that the fusion belt 33 is rotatably tensioned.

As described above, in the present embodiment, the thickness of the elastic layer of the pressure application roller is made less than the thickness of the elastic layer of the fusion roller in the belt heating type fuser. Therefore, the temperature of the pressure application roller increases fast, and the surface temperature of the pressure application roller is increased to the temperature needed for start of printing during the warm-up. As a result, the difference in temperatures of the fusion unit and the pressure application roller at the time of fusion is reduced. Accordingly, the fuser allows the reverse curling amount to be reduced. In addition, the warm-up time at the time of start of printing is shortened.

Second Embodiment

Figure 14:
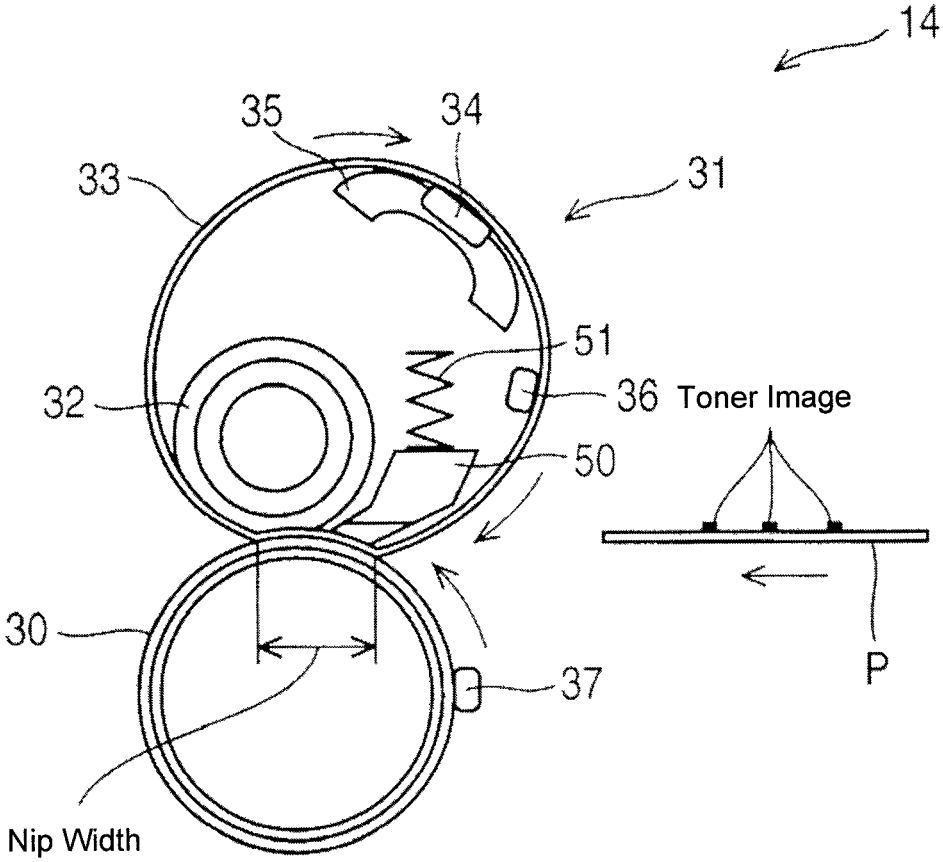
FIG. 14 is an explanatory diagram illustrating a cross-section of a main part of the fuser of a second embodiment.

The fuser of the present embodiment is explained with reference to FIGS. 14 to 19 below. Explanation of parts that are similar to the first embodiment is omitted by adding the same reference numerals. As shown in FIG. 14, in the fuser 14 of the present embodiment, a pad 50 is provided as a pressure member inside the fusion belt and adjacent to the upstream side of the fusion roller 32 in the rotational direction of the fusion belt 33 (clockwise direction in FIG. 14). The pad 50 is urged in a direction to press the pressure application roller 30 through the fusion belt 33 by a sprint member 51, such as a compressed coil spring or the like, so as to form the nip part between pressure application roller 30 and the pad 50 and the fusion roller 32.

As a result, the nip width is made longer than that in the above-described first embodiment, resulting in improved fusion speed. In addition, the outer diameter of the fusion roller 32 is made small. Therefore, by reducing the heat capacity of the fusion belt unit 31, the warm-up time is decreased. Therefore, in the present embodiment, the print speed is configured to 40 ppm for carrying A4 size paper in the portrait orientation, and the warm-up time is configured to 20 seconds. The fusion belt 33 of the present embodiment, which is similar to the first embodiment. has an inner diameter of 45 mm.

Figure 15:
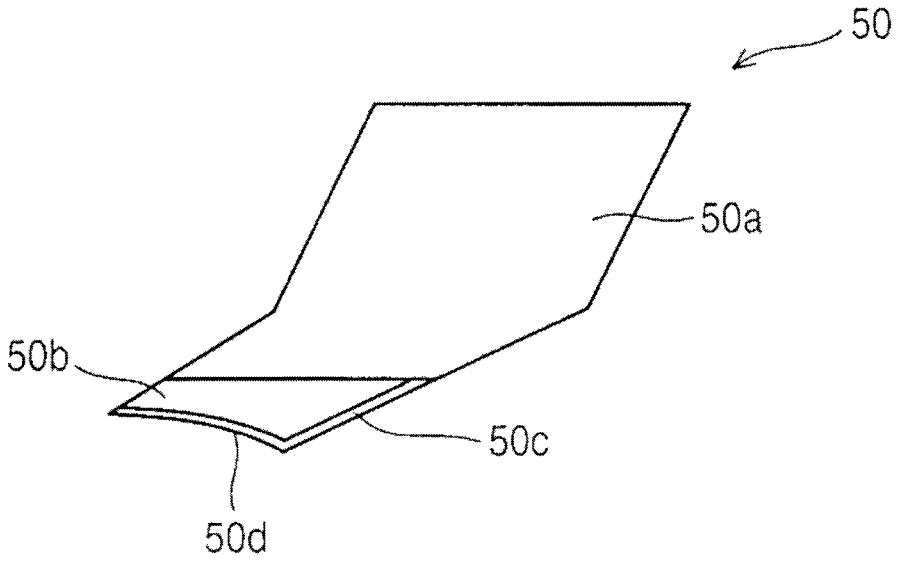
FIG. 15 is an explanatory diagram illustrating a configuration of a pressure member of the second embodiment.

As shown in FIG. 15, the pad 50 is configured from a support base 50*a* made of a metal, such as aluminum, an elastic material 50*b* adhered and fixed to the support base 50*a*, and a sliding layer 50*c* provided on a surface layer of the elastic material 50*b*. The elastic material 50*b* is formed with an arc surface 50*d* that has the same radius of curvature of the pressure application roller 30 via the fusion belt 33.

In the pad 50 of the present embodiment, the support base 50*a* is made of an aluminum material (material: A6063), and the elastic material 50*b* is formed by a silicone rubber. The sliding layer 50*c* is configured by coating the PFA resin having a thickness of 30 μm, and an arc length of the arc surface 50*d* is configured to 5 mm.

The configuration of the fusion roller 32 of the present embodiment is similar to the above-described first embodiment. The core shaft 32*a* is configured from a pipe made of an iron material (material: STKM) with a diameter of 23 mm, a thickness t3 of 1.5 mm (t3=1.5 mm) and a length of 230 mm, and an elastic layer 32*b* formed by a silicone rubber layer having a thickness t4 of 1 mm (t4=1 mm). The fusion roller 32 has an outer diameter of 26 mm.

The configuration of the pressure application roller 30 of the present embodiment is similar to the first embodiment but different in the following. The core shaft 30*a* is configured from a pipe formed of an iron material (material: STKM) having a diameter of 28 mm, a thickness t1 of 0.5 mm (t1=50 mm) and a length of 230 mm. A silicone rubber layer having a thickness t2 is formed as an elastic layer 30*b*. The surface of the pressure application roller 30 is covered by a PFA resin tube as a separation layer 30*c* having a thickness of 40 μm. The pressure application roller 30 has an outer diameter of 36 mm. The thickness t2 of the elastic layer 30*b* is discussed later.

Print operation of the printer 1 and fusion operation of the fuser 14 in the present embodiment are the same as those in the above-described first embodiment. Therefore, their explanation is omitted. For the belt heating type fuser 14 with the configuration of the present embodiment, the evaluation test similar to the first embodiment was conducted by changing the thickness t2 of the elastic layer 30*b* of the pressure application roller 30 to study a configuration for suppressing the reverse curling amount.

As shown in FIG. 16, sample pressure application rollers 30 subject for the evaluation had an outer diameter of 36 mm with a core shaft 30*a* (material: STKM) having the same thickness t1 of 1.5 mm and an elastic layer 30*b* of various thicknesses t2 of 0.5 mm, 1 mm, 2 mm and 3 mm (eighth to eleventh samples (samples 8 to 11)). The fusion roller 32 that was paired with each sample pressure application roller 30 had the configuration of the present embodiment as discussed above. The fusion belt 33 had the same configuration as that in the first embodiment. In addition, the print speed in the evaluation test in the present embodiment was 40 ppm for carrying A4 size paper in the portrait orientation.

Evaluation results of each sample pressure application roller 30 according to the above-described evaluation conditions are shown in FIG. 16. As shown in FIG. 16, it is observed that the starting pressure application roller end-point temperature at the time of start of printing immediately after the warm-up of the pressure application roller 30 is at a temperature at which the reverse curling amount that causes a stacking failure does not occur, when the elastic layer thickness t2 of the pressure application roller 30 is less than the elastic layer thickness t4 of the fusion roller 32.

Figure 17:
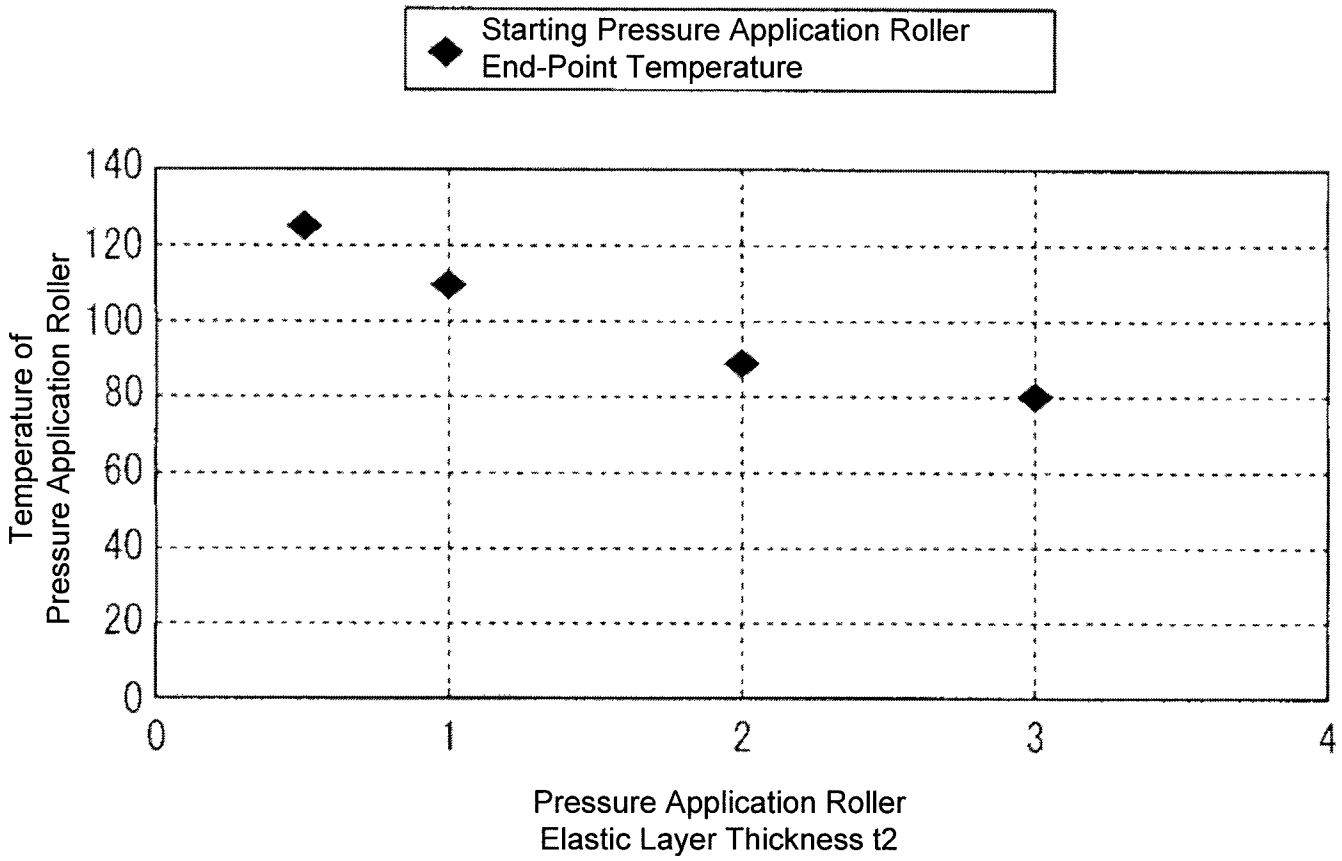
Figure 18:
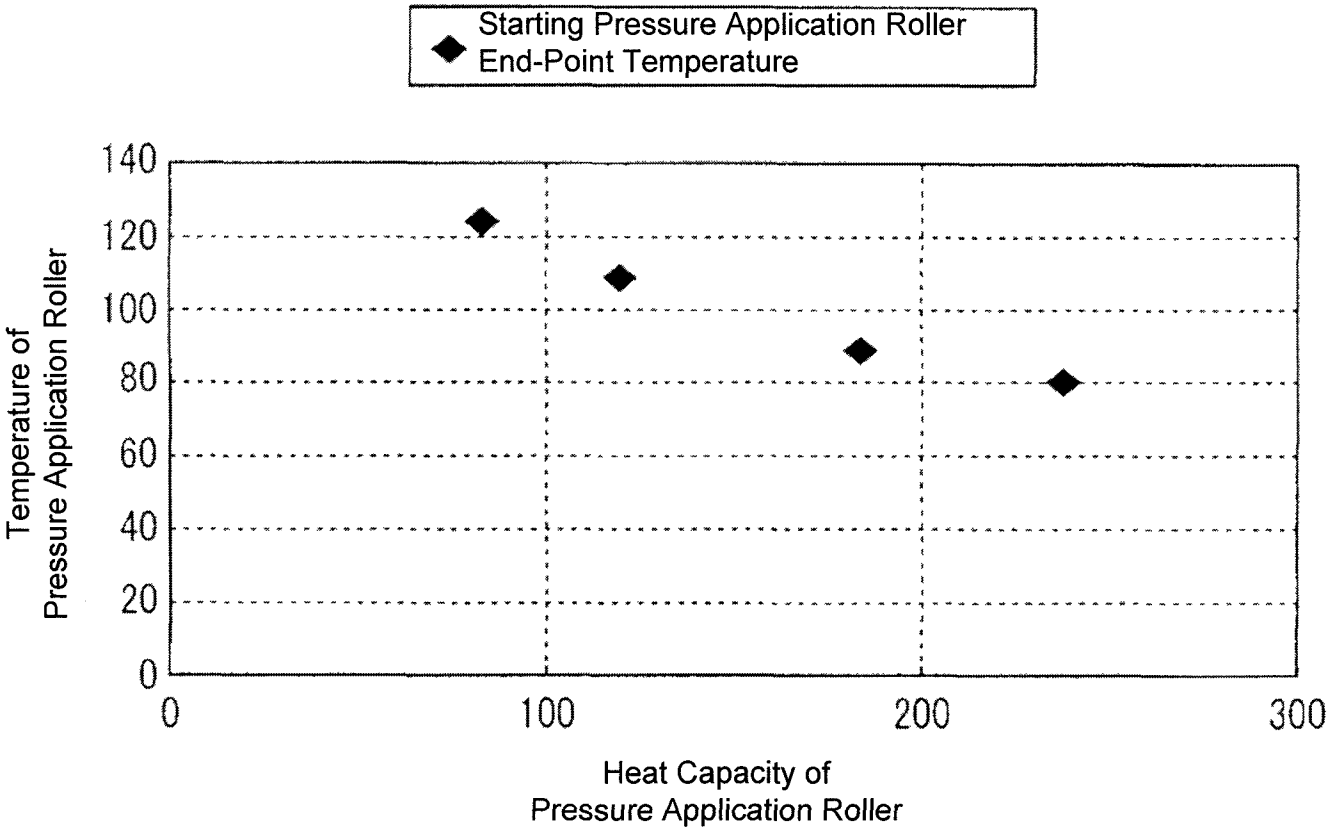
FIG. 18 is a graph illustrating a relationship between the heat capacity of the heat application roller and the temperature to which the pressure application roller reaches at the time of turning on in the second embodiment.

Explaining in more details, as shown in FIG. 17, the starting pressure application roller end-point temperature at the time when the fusion belt 33 reaches the fusion target temperature fusion from the from the room temperature at the time of warming up increases from 80° C. to 125° C. as the elastic layer thickness t2 of the pressure application roller 30 decreases from 3 mm to 0.5 mm. Moreover, as shown in FIG. 18, the starting pressure application roller end-point temperature increases from 80° C. to 125° C. as a heat capacity of the pressure application roller 30 is decreased from 240 J/K to 84 J/K.

Figure 19:
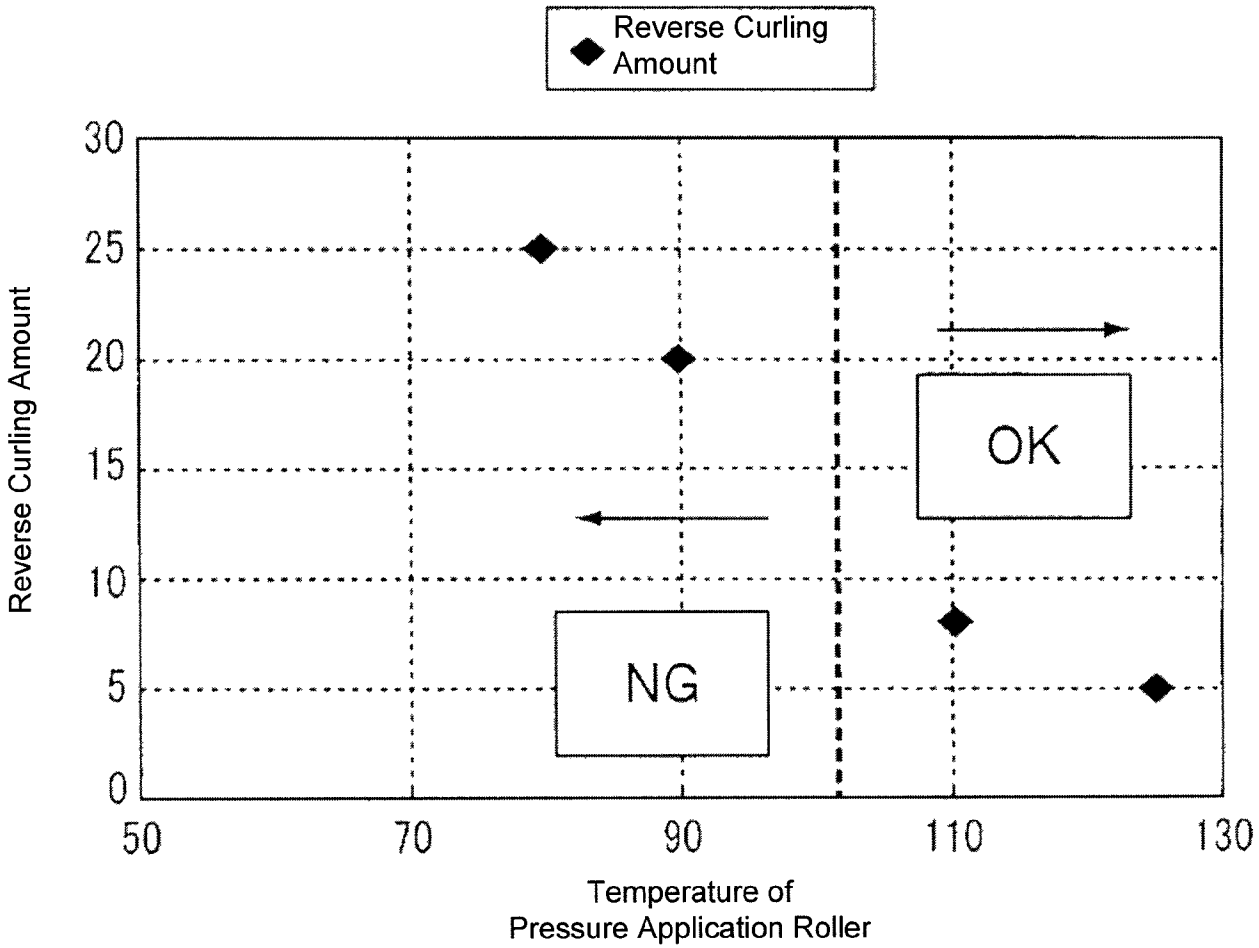
FIG. 19 is a graph illustrating a relationship between the temperature to which the pressure application roller reaches at the time of turning on and the amount of reverse curling in the second embodiment.

As shown in FIG. 19, the reverse curling amount of the sheet P at this time decreases from 25 mm to 5 mm as the starting pressure application roller end-point temperature increases. The stacking condition after printing 50 sheets shows a stacking result with no or little disarrangement when the reverse curling amount is 10 mm or less.

That is, if the relationship of thicknesses between the elastic layer 30*b* of the pressure application roller 30 and the elastic layer 32*b* of the fusion roller 32 is configured to a. Elastic layer thickness t2 of pressure application roller<Elastic layer thickness t4 of fusion roller (3)

the reverse curling amount at the time of start of printing immediately after the warm-up is controlled at 10 mm or less, resulting in an excellent stacking condition.

In addition, if the relationship of heat capacity of the pressure application roller 30 and heat capacity of the fusion roller 32 is configured to a. Heat capacity of pressure application roller<Heat capacity of fusion roller (4)

the reverse curling amount at the time of start of printing immediately after the warm-up is controlled at 10 mm or less, resulting in an excellent stacking condition.

As described above, it was understood that a large reverse curling amount occurs when the heat capacity is large and that the reverse curling amount is small when the heat capacity of the heat roller 30 is reduced, even with the same configuration. When the relationship of the elastic layer thickness t4 of the fusion roller 32 and fusibility was studied by another test, occurrence of fusion defects was slightly observed with the elastic layer thickness t4 of 1 mm. Therefore, it is necessary that a more preferred elastic layer thickness t4 of the fusion roller 32 is 2 mm or more. In the embodiment, the outer diameter of the fusion roller 32 is 25 mm. Therefore, the preferred elastic layer thickness is approximately 8% ore more with respect to the outer diameter.

As described above, similar to the first embodiment, in the present embodiment, the thickness of the elastic layer 30*b* of the pressure application roller 30 for the fuser 14 is made less than the thickness of the elastic layer 32*b* of the fusion roller 32. Therefore, the temperature of the pressure application roller 30 increases fast, and the surface temperature of the pressure application roller 30 is increased to the temperature needed for start of printing during the warm-up. As a result, the difference in temperatures of the fusion unit 31 and the pressure application roller 30 at the time of fusion is reduced, and the difference in dryness of the front and back sides of the sheet P. Accordingly, the fuser 14 that allows the reverse curling amount to be reduced can be provided. In addition, because the temperature increase of the fusion roller 30 is increased, the warm-up time at the time of start of printing is shortened.

Furthermore, the printer 1 of the present embodiment, with the fuser 14, provides excellent sheet carrying ability and stackability for the fusion process after being turned on and recovery from a power saving mode.

In addition, in the present embodiment, because of the pad 50 added to the fuser 14, the nip width is configured longer than the first embodiment. Therefore, the fusion speed is improved, and the outer diameter of the fusion roller 32 can be reduced. As a result, the heat capacity of the fusion unit 31 is reduced, and the warm-up time at the time of starting printing is shortened.

As described above, in the present embodiment, the thickness of the elastic layer of the pressure application roller is made less than the thickness of the elastic layer of the fusion roller in the belt heating type fuser, and a pad that presses the pressure application roller via the fusion belt is provided adjacent to the fusion roller. Therefore, the temperature of the pressure application roller increases quickly, and the surface temperature of the pressure application roller is increased to the temperature needed for the start of printing during the warm-up. As a result, the difference in temperatures of the fusion unit and the pressure application roller at the time of fusion is reduced. Accordingly, the fuser allows the reverse curling amount to be reduced. In addition, the warm-up time at the time of start of printing is further shortened.

The present embodiments are not limited to those described above, and various changes and modifications are available without departing from the scope of the invention. In addition, the description of members disclosed in the present application is examples and are not to be limited to the description. Moreover, in each of the above-described embodiments, the print medium is normal paper. However, the medium is not limited to this and may be an overhead projector (OHP) sheet, a card, a post card, a thickness having a weight of about 200 g/m$^2$ or more, an envelope, and a special paper such as a coated paper having a large heat capacity and the like.

Further, in each of the above-described embodiments, the heating member is explained as a sheet heater or a halogen heater. However, the heating member may be a cylindrical heater having a sliding surface against the fusion belt that has approximately the same radius of curvature as that for the fusion belt. Types and shapes of the heating member are not limited. Furthermore, in each of the above-described embodiments, the heater is described as being provided inside the fusion belt. However, the heater may be provided outside the fusion belt.

Concerning the temperature increase of the pressure application roller 30 and the fusion roller 32, there is a high dependability to the thickness of the elastic layer of each roller. Therefore, materials and characteristics of the elastic layers of the pressure application roller 30 and the fusion roller 32 are not limited, although the same material is preferred for stabilizing the heat transfer.

In addition, in the present embodiments, the material of the elastic layers of the pressure application roller 30 and the fusion roller 32 is silicone rubber in consideration of heat tolerance, antifriction, heat resistance and the like. The silicone rubber may be formed by liquid silicone rubber or millable-type silicon rubber. Moreover, a foaming condition of the elastic layer may be a solid state (expansion ratio=1) or a foam state (expansion ratio>1). In the present embodiments, the elastic layer of the pressure application roller 30 is formed by the liquid silicone rubber in the solid state. Further, the elastic layer of the fusion roller 32 is formed by the liquid silicone rubber in the solid state.

In the present embodiments, the foaming condition of the pressure application roller 30 and the fusion roller 32 is in the solid state. However, similar effects can be obtained with the combination of any foaming condition in the present application, as long as the expansion ratio is between 1.0 and 5. Here, the expansion ratio is a ratio of volume expansion of a foam plastic having the same mass in comparison with the foam plastic in the solid state, or refers to a value of an apparent density of the foam plastic divided by a density of a synthetic resin before foaming.

Further, in the present embodiments, the fusion roller 32 is explained to be driven and rotated by the pressure application roller 30. However, if the fusion roller 32 is rotated as the driving side, and if the pressure roller 30 is driven and rotated, the fusion belt 33 is evenly carried by the fusion roller 32 with the elastic layer of the pressure application roller 30 being in the solid state and with the elastic layer of the fusion roller 32 being in the foam state. As a result, an effect, such as stable fusion quality, is obtained.

Furthermore, as explained in the first embodiment, if the core material of the fusion roller 32 and the pressure application roller 30 is aluminum, the thickness of the core is preferably set to 0.5 to 2.0 mm. In addition, more effects are obtained by setting the thickness of the elastic layer of the pressure application roller 30 by 0.4 to 0.8 times of the thickness of the elastic layer of the fusion roller 32.

Moreover, as explained in the second embodiment, if the core material of the fusion roller 32 and the pressure application roller 30 is iron, the thickness of the core is preferably set to 0.3 to 2.0 mm. In addition, more effects are obtained by setting the thickness of the elastic layer of the pressure application roller 30 by 0.25 to 0.8 times of the thickness of the elastic layer of the fusion roller 32.

In addition, with respect to the diameters of the fusion roller and the pressure application roller, the diameter of the fusion roller 32 and the diameter of the pressure application roller 30 are configured approximately the same in the present embodiments. However, the same effects are obtained as long as the diameter of the fusion roller 32 is in ±10% of the diameter of the pressure application roller 30.

In each of the above-described embodiments, the image forming device is explained as a color printer. However, it is not limited to this and may be a monochrome printer, a copy machine, a facsimile device, a multi function peripheral and the like that uses the electrographic method.

What is claimed is:

1. A fuser, comprising:

a first roller that includes a first core formed in a pipe shape in a cross-section and a first elastic layer formed on an outer periphery side of the first core;

an endless belt member that is provided on and rotates around the first roller;

a second roller that includes a second core formed in a pipe shape in a cross-section and a second elastic layer formed on an outer periphery side of the second core and that forms a nip part by pressing, through the belt member, the first roller; and a heating member that is positioned on an inner periphery side of the belt member and that heats the belt member, wherein the first core and the second core are made of substantially the same material, the first elastic layer and the second elastic layer are made of substantially the same material, a thickness of the second elastic layer of the second roller is less than a thickness of the first elastic layer of the first roller, a heat capacity of the second roller is less than a heat capacity of the first roller by 59 or more [J/K ], and the second roller is heated by the belt member that has been heated by the heating member.

2. The fuser according to claim 1, wherein diameters of the first and second elastic layers are substantially identical.

3. The fuser according to claim 1, wherein the material of the first and second elastic layers is silicone rubber.

4. The fuser according to claim 1, wherein an outer diameter of the second roller is identical to an outer diameter of the first roller.

5. The fuser according to claim 1, wherein the first elastic layer of the first roller has a thickness of at least 2 mm.

6. The fuser according to claim 1, wherein the first roller is a fusion roller, and the second roller is a pressure application roller.

7. The fuser according to claim 6, further comprising:

a pressure member that is provided adjacent to the fusion roller and that presses, through the belt member, the second roller.

8. The fuser according to claim 1, wherein the heating member is a sheet heater in a slender shape.

9. The fuser according to claim 8, wherein the sheet heater is disposed such that a longitudinal direction of the sheet heater is substantially in an axis of the belt member.

10. The fuser according to claim 1, wherein the heating member is a halogen heater.

11. The fuser according to claim 1, wherein the silicone rubber of the first elastic layer is foamed.

12. The fuser according to claim 11, wherein
the silicone rubber of the second elastic layer is not foamed but solid.

13. An image forming device, comprising:
the fuser according to claim 1.

14. The fuser according to claim 1, wherein
the thickness of the first elastic layer of the first roller is in a range between 8% and 25% (inclusive) with respect to an outer diameter of the first roller.

15. The fuser according to claim 1, wherein
the second roller is configured to be driven by the first roller to rotate in a medium carrying direction.

16. The fuser according to claim 1, wherein
the material of the first core and the second core is aluminum.

17. The fuser according to claim 1, wherein
the second roller is heated only by the belt member that has been heated by the heating member, and
the heat capacity of the second roller is less than the heat capacity of the first roller thereby an increase in temperature of the second roller is faster than an increase in temperature of the first roller during a warm up period.

18. The fuser according to claim 1, wherein
the thickness of the second elastic layer of the second roller is 0.25 to 0.8 times of the thickness of the first elastic layer of the first roller.

19. The fuser according to claim 1, further comprising:
a pad member that is positioned on an upstream side of the nip part in a direction that the belt member rotates, wherein
the pad member includes:
a support base formed of metal,
an elastic material formed to the support base, and
a sliding layer provided on the elastic material.

20. The fuser according to claim 19, wherein
the support base is made of aluminum.

21. The fuser according to claim 19, wherein
the first elastic layer of the first roller, the second elastic layer of the second roller, and the elastic material of the pad members are formed by silicone rubber,
the first core of the first roller and the second core of the second roller are formed by an iron material, and
the support base of the pad member is formed by aluminum.

22. A fuser, comprising:
a first roller that includes a first core formed in a pipe shape in a cross-section and a first elastic layer formed on an outer periphery side of the first core;
an endless belt member that is provided on and rotates around the first roller;
a second roller that includes a second core formed in a pipe shape in a cross-section and a second elastic layer formed on an outer periphery side of the second core and that forms a nip part by pressing, through the belt member, the first roller;
a heating member that is positioned on an inner periphery side of the belt member and that heats the belt member;
a pad member that is positioned on an upstream side of the nip part in a direction that the belt member rotates, wherein
the first core and the second core are made of substantially the same material,
the first elastic layer and the second elastic layer are made of substantially the same material,
a thickness of the second elastic layer of the second roller is less than a thickness of the first elastic layer of the first roller,
a thickness of the second core is equal to or less than a thickness of the first core,
the second roller is heated by the belt member that has been heated by the heating member, and
the pad member includes:
a support base formed of metal,
an elastic material formed to the support base, and
a sliding layer provided on the elastic material.

23. The fuser according to claim 22, wherein
diameters of the first and second elastic layers are substantially identical.

24. The fuser according to claim 22, wherein
the materials of the first and second elastic layers are silicone rubber.

25. The fuser according to claim 22, wherein
a heat capacity of the second roller is less than a heat capacity of the first roller.

26. The fuser according to claim 22, wherein
the first elastic layer of the first roller has a thickness of at least 2 mm.

27. The fuser according to claim 22, wherein
the first roller is a fusion roller, and the second roller is a pressure application roller.

28. The fuser according to claim 22, wherein
the heating member is a sheet heater in a slender shape.

29. The fuser according to claim 28, wherein
the sheet heater is disposed such that a longitudinal direction of the sheet heater is substantially in an axis of the belt member.

30. The fuser according to claim 22, wherein
the heating member is a halogen heater.

31. The fuser according to claim 22, wherein
the silicone rubber of the first elastic layer is foamed.

32. The fuser according to claim 31, wherein
the silicone rubber of the second elastic layer is not foamed but solid.

33. An image forming device, comprising:
the fuser according to claim 22.

34. The fuser according to claim 22, wherein
the thickness of the first elastic layer of the first roller is in a range between 8% and 25% (inclusive) with respect to an outer diameter of the first roller.

35. The fuser according to claim 22, wherein
the second roller is configured to be driven by the first roller to rotate in a medium carrying direction.

36. The fuser according to claim 22, wherein
the thickness of the first core and the thickness of the second core are substantially identical.

37. The fuser according to claim 22, wherein
the material of the first core and the second core is aluminum.

38. The fuser according to claim 22, wherein
the second roller is heated only by the belt member that has been heated by the heating member, and
a heat capacity of the second roller is less than a heat capacity of the first roller by 59 or more [J/K], and thereby an increase in temperature of the second roller is faster than an increase in temperature of the first roller during a warm up period.

39. The fuser according to claim 22, wherein
the thickness of the second elastic layer of the second roller is 0.25 to 0.8 times of the thickness of the first elastic layer of the first roller.

40. The fuser according to claim 22, wherein
the support base is made of aluminum.

41. The fuser according to claim 22, wherein the first elastic layer of the first roller, the second elastic layer of the second roller, and the elastic material of the pad members are formed by silicone rubber, the first core of the first roller and the second core of the second roller are formed by an iron material, and the support base of the pad member is formed by aluminum.

* * * * *